US008113504B2

(12) United States Patent
Cahill

(10) Patent No.: US 8,113,504 B2
(45) Date of Patent: Feb. 14, 2012

(54) MEDIA SHEET FEEDING METHOD FOR OVERCOMING AT LEAST ONE MEDIA HANDLING FAILURE MODE

(75) Inventor: Daniel Paul Cahill, Verona, KY (US)

(73) Assignee: Lexmark International, Inc., Lexington, KY (US)

( * ) Notice: Subject to any disclaimer, the term of this patent is extended or adjusted under 35 U.S.C. 154(b) by 184 days.

(21) Appl. No.: 12/266,232

(22) Filed: Nov. 6, 2008

(65) Prior Publication Data

US 2010/0109230 A1 May 6, 2010

(51) Int. Cl.
*B65H 1/18* (2006.01)

(52) U.S. Cl. ..... 271/152; 271/153; 271/154; 271/156; 271/126

(58) Field of Classification Search ..... 271/152, 271/153, 258.03, 258.04, 126, 127, 154
See application file for complete search history.

(56) References Cited

U.S. PATENT DOCUMENTS 3,724,839 A * 4/1973 Suzuki ..... 271/117
4,307,957 A * 12/1981 Kitagawa et al. ..... 399/21
4,482,143 A * 11/1984 Della Torre ..... 271/18.3
4,925,177 A * 5/1990 Nakamura et al. ..... 271/110
5,104,109 A * 4/1992 Kubo ..... 271/3.12
5,346,199 A * 9/1994 Martin et al. ..... 271/110
5,552,859 A * 9/1996 Nakagawa et al. ..... 399/23
6,032,944 A * 3/2000 Lee ..... 271/110
6,293,539 B1 * 9/2001 Fukatsu et al. ..... 271/126
6,880,819 B2 * 4/2005 Chen et al. ..... 271/258.01
7,451,976 B2 * 11/2008 Nam ..... 271/152
7,594,647 B2 * 9/2009 DeVore et al. ..... 271/10.09

FOREIGN PATENT DOCUMENTS

JP 63202523 A * 8/1988
JP 01313223 A * 12/1989
JP 03102018 A * 4/1991

* cited by examiner

*Primary Examiner* — Michael McCullough
*Assistant Examiner* — Luis A Gonzalez
(74) *Attorney, Agent, or Firm* — John Victor Pezdek

(57) ABSTRACT

A sheet feeding method includes supporting a media stack on an elevator, initiating operation of a pick roll in conjunction with a top most sheet, sensing whether or not the pick roll is operating in conjunction with the top most sheet, and moving the elevator, in response to the pick roll not operating in conjunction with the top most sheet, to overcome occurrence of a media handling failure mode between the pick roll and the top most sheet. The elevator is lowered, in response to the pick roll rotating but the top most sheet not arriving at a sheet arrival sensor, to increase a normal force imposed on the top most sheet to overcome the occurrence of a 'fails to feed' failure mode. The elevator is raised, in response to the pick roll not rotating, to decrease the normal force imposed on the top most sheet to overcome the occurrence of a 'pick roll stall' failure mode.

20 Claims, 3 Drawing Sheets

MEDIA SHEET FEEDING METHOD FOR OVERCOMING AT LEAST ONE MEDIA HANDLING FAILURE MODE

CROSS REFERENCES TO RELATED APPLICATIONS

None.

BACKGROUND

1. Field of the Invention

The present invention relates generally to a media handling device in an image forming machine and, more particularly, to a media sheet feeding method for overcoming at least one media handling failure mode.

2. Description of the Related Art

A high capacity media handling device of an image forming machine typically includes a pick mechanism that feeds media a sheet at a time from pick positions to a downstream media process, such as printing, copying and the like, and an elevator that lifts a stack of media sheets so as to place the top of the stack at a selected pick position relative to the pick mechanism. The pick mechanism includes a pick arm pivotally mounted at one end and having a pick roll mounted at its free end that contacts a top sheet of a media stack. The pick roll includes a friction surface, oftentimes in the form of one or more tires. The pick positions may be at any of a plurality of levels that intersect an inclined surface on a wear or restraint dam of an input tray between the upper and lower ends of the dam. The pick mechanism is able to feed media a sheet at a time most reliably when the top of the stack is at any one of the pick positions. When the media sheets are picked one at a time from the stack to supply the media process, the level of the top of the stack decreases and potentially could go below the lowest level of the pick positions. The main function of the elevator is to return the top of the stack toward the upper limit of the pick positions before it goes below the lower limit thereof which may be the same as the lower end of the inclined surface of the dam.

It is generally the case that the timing for lifting the stack by the elevator should be such that the stack is not lifted when the pick mechanism is feeding sheets of media from the stack. It is understood that doing both at the same time could introduce adverse forces on the stack since the pick mechanism is pressing downward on the stack as the elevator is lifting the stack upward. As a result, heretofore the pick mechanism has been the only prime mover that acts on the top media sheet when it is being first moved from the stack and separated from the next sheet below it. The pick mechanism also includes a gear train supported by the pick arm and operable to transmit both a rotational force and a downward or normal force to the pick roll. The amount of the downward or normal force applied through the pick roll impacts the amount of frictional force created between the pick roll and the top most sheet.

In many media handling devices, the pick mechanism assumes a near horizontal orientation relative to the top of the media stack when the top of the stack is at the upper limit of the pick positions. In the near horizontal orientation, the normal force exerted by the pick mechanism on the stack by rotation of the pick roll may be too low to create the frictional force necessary to overcome both the friction between the top most sheet, the next sheet directly beneath it and the force necessary to buckle the top sheet up the dam. This is termed a 'fails to feed' failure mode. Also, in many media handling devices, the pick mechanism assumes a maximum downward sloped orientation relative to the top of the media stack when the top of the stack is at the lower limit of the pick positions. In the maximum downward sloped orientation, the normal force exerted by the pick mechanism on the stack by rotation of the pick roll may be too high, creating so much friction that it may cause what is termed a 'sheet feed stall' failure mode to occur.

Thus, there is a need for an innovation that will overcome these failure modes due to creation of frictional forces that are too high when the pick mechanism is at the lower limit or too low when the pick mechanism is at the upper limit of the pick position.

SUMMARY OF THE INVENTION

The present invention meets this need by providing an innovation that allows the top most sheet of the media stack to be acted upon by both the pick mechanism and the stack elevator at the same time or in close unison with one another to move the top most sheet off the media stack, without advancing the next sheet in the stack, in response to sensing the occurrence of a corresponding one of these media handling failure modes.

Accordingly, in an aspect of the present invention, a media sheet feeding method for overcoming at least one media handling failure mode includes supporting a media stack on a generally vertically movable elevator, initiating operation of a pick roll in conjunction with a top most sheet of the media stack, sensing whether or not the pick roll is operating in a preselected manner in conjunction with the top most sheet, and moving the elevator vertically in a selected direction through a preset distance, in response to the pick roll not operating in the preselected manner in conjunction with the top most sheet, in order to overcome the occurrence of a media handling failure mode between the pick roll and the top most sheet. The elevator is lowered, in response to the pick roll rotating but the top most sheet not arriving at a sheet arrival sensor, to increase a normal force imposed on the top most sheet to overcome the occurrence of a 'fails to feed' failure mode. The elevator is raised, in response to the pick roll not rotating, to decrease the normal force imposed on the top most sheet to overcome the occurrence of a 'pick roll stall' failure mode.

In another aspect of the present invention, a media sheet feeding method for overcoming at least one media handling failure mode includes supporting a media stack on a generally vertically movable elevator, initiating operation of a pick roll by transmitting rotary motive power thereto and engaging the pick roll with a top most sheet of the media stack in order to pick and separate the top most sheet from the next sheet beneath the top most sheet and feed just the top most sheet from the stack, sensing whether or not the pick roll is rotating and whether or not the top most sheet has arrived at a sheet arrival sensor to determine whether or not a media handling failure mode has occurred, and moving the elevator in a predetermined direction through a preset distance, in response to the pick roll not rotating within a preset time and/or the top most sheet not arriving within a preset time after initiating operation of the pick roll, in order to sufficiently change a normal force imposed on the top most sheet by the pick roll so as to overcome the occurrence of a media handling failure mode.

BRIEF DESCRIPTION OF THE DRAWINGS

Figure 1:
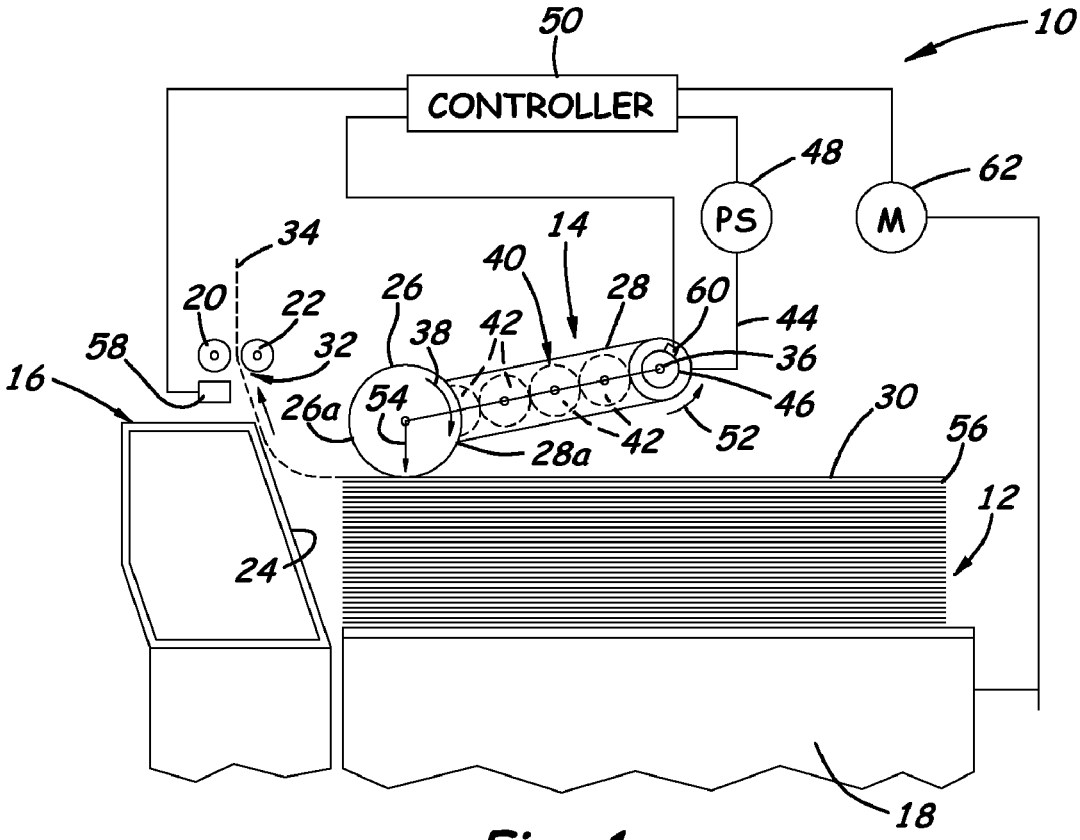

Having thus described the invention in general terms, reference will now be made to the accompanying drawings, which are not necessarily drawn to scale and in some instances portions may be exaggerated in order to emphasize features of the invention, and wherein:

FIG. 1 is a schematic representation of a media handling device embodying the sheet feeding system and method of the present invention, showing a stack elevator supporting a media stack with its top most sheet at an upper limit of pick positions relative to a restraint dam, and a pick mechanism at a near horizontal orientation with its pick roll rotating but experiencing a "fails to feed" failure mode relative to the top most sheet of the media stack.

Figure 2:
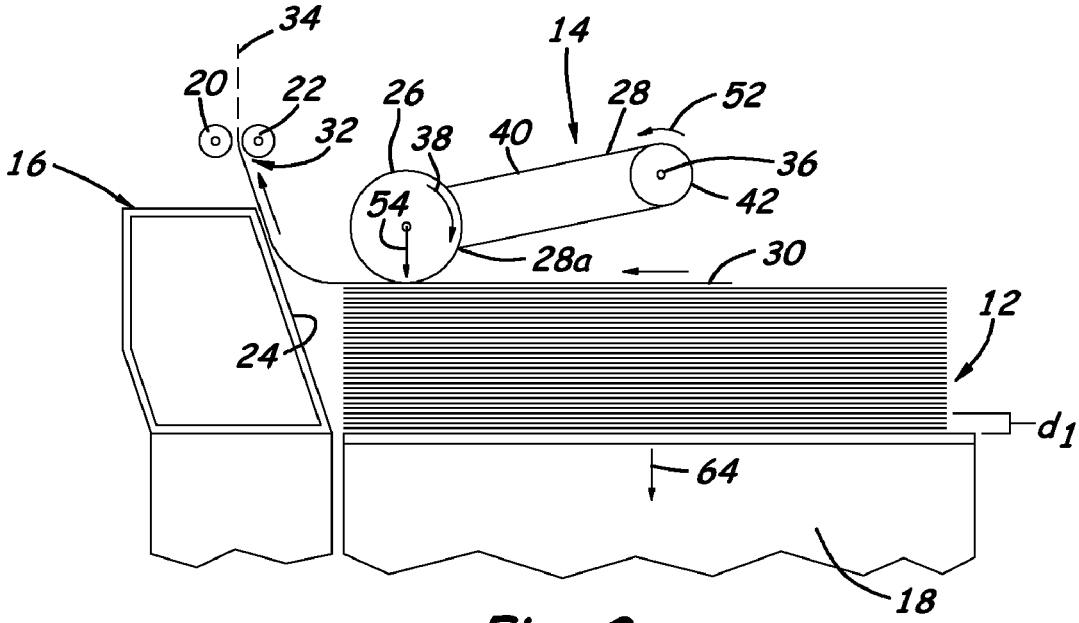

FIG. 2 is a schematic representation of the media handling device similar to that of FIG. 1 but now showing lowering the stack elevator through a short distance as the pick roll of the pick mechanism continuing to rotate overcomes the failure mode depicted in FIG. 1 by successfully picking the top most sheet from the media stack and pushing it against the restraint dam where it is deflected in an upward direction to a media path.

Figure 3:
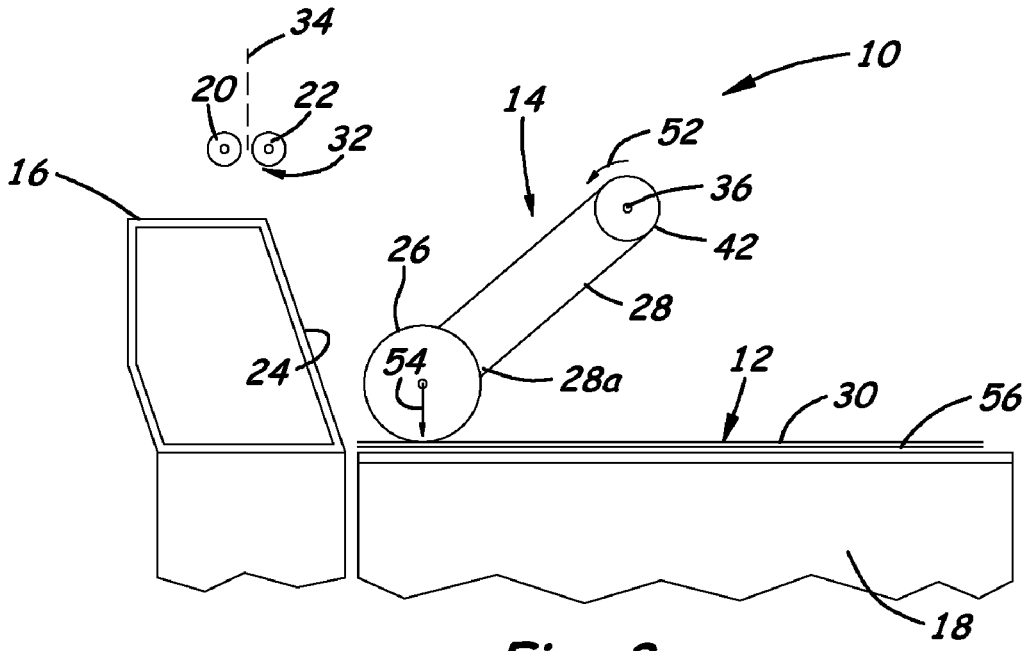

FIG. 3 is a schematic representation of the media handling device similar to that of FIG. 1 but now showing the stack elevator supporting a depleted media stack with its top most sheet at a lower limit of pick positions relative to the restraint dam, and the pick mechanism at a maximum downward sloped orientation with its pick roll not rotating but instead experiencing a 'sheet feed stall' failure mode.

Figure 4:
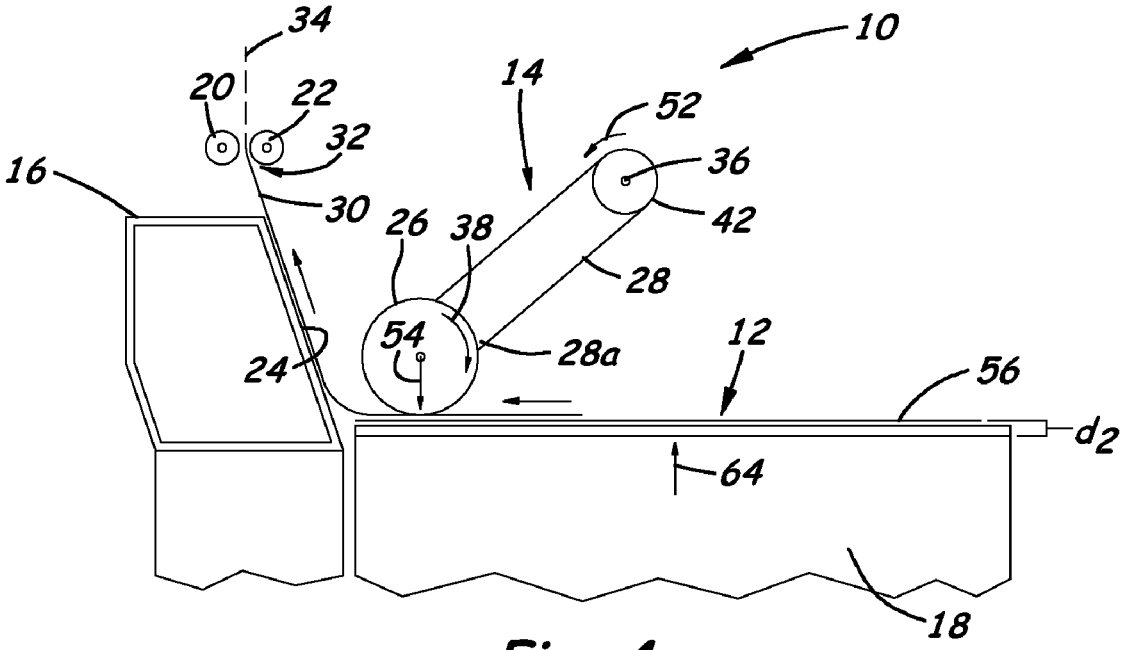

FIG. 4 is a schematic representation of the media handling device similar to that of FIG. 3 but now showing raising the stack elevator through a short distance as the pick roll of the pick mechanism resumes rotation and overcomes the failure mode depicted in FIG. 3 by successfully picking the top most sheet from the media stack and pushing it against the restraint dam where it is deflected in the upward direction to the media path.

Figure 5:
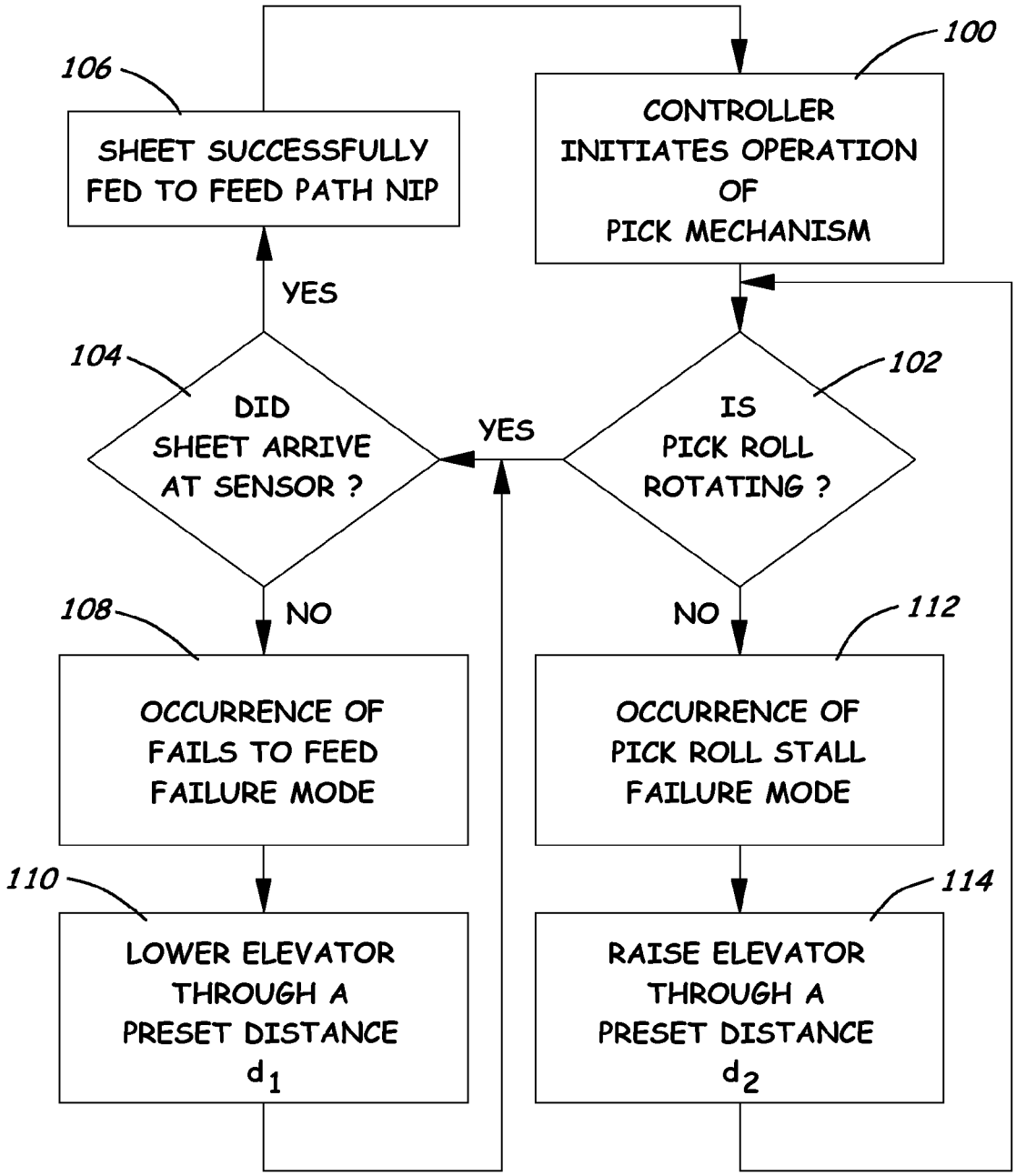

FIG. 5 is a flowchart depicting operational steps of the media sheet feeding method of the present invention for overcoming the media handling failure modes depicted in FIGS. 1 and 3 in the manner depicted in FIGS. 2 and 4.

DETAILED DESCRIPTION

The present invention now will be described more fully hereinafter with reference to the accompanying drawings, in which some, but not all embodiments of the present invention are shown. Indeed, the present invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated a schematic representation of a high capacity media handing device, generally designated 10, of an image forming machine (not shown) embodying the sheet feeding method of the present invention for overcoming multiple media handling failure modes during the feeding of media a sheet at a time from a stack 12 to a downstream media process, such as printing, copying and the like. The media handling device 10 includes a pick mechanism 14 operatively disposed above the media stack 12, a buckler or restraint dam 16 disposed adjacent to and forwardly of the pick mechanism 14, an elevator 18 disposed below the pick mechanism 14 and on which the stack 12 of media sheets is loaded and being operable for lifting and lowering the same toward and away from the pick mechanism 14, and a pair of de-skew or feed-through rollers 20, 22 disposed above and aligned with an inclined surface 24 of the restraint dam 16. The pick mechanism 14 has a pick roll 26 on an end 28a of an arm 28 pivotally mounted so as to maintain the pick roll 26 on the top most sheet 30 of the stack 12 of media sheets. The top most sheet 30 of the stack 12 is pushed against the inclined surface 24 of the restraint dam 16 by the pick mechanism 14 and deflected in an upward direction to and between the rollers 20, 22 at an entry nip 32 to a media path 34 of the image forming machine.

The pick arm 28 is free pivoted about a point 36 at least by gravity so as to maintain its pick roll 26 on the top most sheet 30 of the media stack 12. The pick roll 26 rotates in a clockwise direction, as indicated by arrow 38 and depicted in FIG. 1, to move the top most sheet 30 off the stack 12 and into the restraint dam 16. The pick mechanism 14 may include a drive train 40 operatively mounted on the pick arm 28 for transferring a driving force to the pick roll 26. The drive train 40 includes a series of gears 42, shown in dashed outline form in FIG. 1, that extend through the pick arm 28 and a plurality of pulleys and belts, as represented by line 44, for transferring rotary power from a motor 46 to rotate the pick roll 26. The motor 46 is operatively connected to a power supply 48 which, in turn, is operatively connected to a controller 50. The motor 46 includes an encoder that is monitored by the controller 50 to control and regulate the speed of the motor 46. The controller 50 receives data representing the drive current of the motor 46 and may send pick and timing commands to the motor 46 establishing the timing and speeds for picking the top most media sheet 30 from the stack 12.

In operation, a pick command is sent by the controller 50 to the motor 46 causing it to drive rotation of the gears 42 of the drive train 40 within the pick arm 28 which, in turn, causes a downward torque, in a counterclockwise direction as indicated by arrow 52 and viewed in FIG. 1, to be applied to the pick arm 28 which is free to pivot about the point 36. The rotation of the gears 42 further results in rotation of the pick roll 26 in the clockwise direction of arrow 38 as viewed in FIG. 1. The foregoing arrangement is typically designed for a 'no slip' condition to be produced between an outer tire surface 26*a* of the pick roll 26 and the top most sheet 30, and the applied torque is intended to cause an increase in a normal force in a downward direction, as indicated by arrow 54 and viewed in FIG. 1, between the pick roll 26 and the top most sheet 30. The top most sheet 30 is pressed with increasing force until the pick roll 26 begins to rotate. As the pick roll 26 rotates, the frictional adhesion between the tire surface of the pick roll 26 and the top media sheet 30 causes the top most sheet 30 to move or be pushed free of the next sheet 56 beneath it and towards the inclined surface 24 of the restraint dam 16. The moved sheet 30 contacts the inclined surface 24 of the restraint dam 16 so as to temporarily restrain, restrict or hinder further movement of the sheet 30. This hindrance causes the torque applied by the gears 42 to increase the normal force in the direction of arrow 54 between the pick roll 26 and the sheet 30. The normal force will continue to build up causing the media sheet 30 to slightly buckle downward. As the buckle grows in size (not shown) the leading end of the sheet 30 then moves up the inclined surface 24 of the restraint dam 16, concurrently unbuckling as it moves, into the entry nip 32 of the media path 34 between the rollers 20, 22. The pick roll 26 then continues to rotate and feed the sheet 30 to the rollers 20, 22. A sheet arrival sensor 58 connected to the controller 50 may be positioned adjacent to the rollers 20, 22 to detect the arrival of the leading edge of the sheet 30 and generate a signal that is received at the controller 50.

However, when the pick arm 28 is in the near horizontal orientation and thus extends near parallel with the top of the media stack 12 as shown in FIG. 1, the pick arm 28 is in a geometrical relationship with the top of the media stack 12 that is the least disposed to allow it to increase the normal force, in the direction of arrow 54, imposed on the stack 12, as compared to when it is in the downward inclined orientation relative to the top of the media stack 12 as in FIG. 3 where the pick arm 28 is then in a geometrical relationship with the top of the media stack 12 that is most disposed to allow the pick arm 28 to increase the normal force imposed on the stack 12. An increased normal force allows the pick arm 28 to move 'difficult to move' media sheets. The near horizontal orientation of the pick arm 28 in FIG. 1, in which it is constrained from increasing the normal force, occasionally results in the occurrence of a 'fails to feed' failure mode of the pick mechanism 14. That is, the pick roll 26 rotates but, due to the aforementioned geometrical relationship, the normal force (as per arrow 54) the pick arm 28 imposes on the top most sheet 30 is too low to create frictional adhesion between the pick roll 26 and the top most sheet 30 sufficient to overcome both the friction between the top most sheet 30 and the sheet 56 directly beneath it and the force necessary to buckle the top most sheet 30 upward along the inclined surface 24 of the restraint dam 16.

Referring now to FIGS. 2 and 5, there is illustrated in FIG. 2 a first feature of the sheet feeding method of the present invention wherein the aforementioned geometrical relationship of the pick arm 28 with the top of the media stack 12 is changed in response to sensing the occurrence of the 'fail to feed' failure mode. FIG. 5 sets forth a plurality of blocks 100-114 making up a flowchart of the sheet feeding method of the present invention which includes this first feature. Initially, as per block 100 of the flowchart, the controller 50 sends instructions to the motor 46, initiating turn-on and thus operation of the motor 46 to drive the pick mechanism 14 and its pick roll 26 to impose a normal force on the stack 12 sufficient to pick and move the top most sheet 30 from the stack 12 toward and up the restraint dam 16, pass the sheet arrival sensor 58 to the rollers 20, 22. A pick sensor 60 supported onboard the pick motor 46 as well as the sheet arrival sensor 58, both electrically connected to the controller 50, will feed various signals to the controller 50 indicating the current status or state of operation of the media handling device 10. The signal from the motor pick sensor 60 will indicate that the pick roll 26 is rotating. The signal from the sheet arrival sensor 58 will indicate arrival of the leading end of the top most sheet 30 and the trailing edge of sheet 30 or the trailing edge of sheet 56 if two sheets are fed at one time. This combination of these signals needs to be received by the controller 50 within preset times following the time of turn-on of the motor 46 to indicate to the controller 50 that the top most sheet 30 has successfully been fed into the media path entry nip 32 of rollers 20, 22. In other words, the answers to both questions "Is pick roll rotating?" and "Did sheet arrive at sensor?", as per respective blocks 102, 104, must be YES to indicate that the top most sheet 30 was fed successfully to media path entry nip 32, as per block 106.

The occurrence of the 'fail to feed' failure mode, as per block 108, is the result when an answer of NO to the question "Did sheet arrive at sensor?", as per block 104, is received at block 108. Thus, the failure of the sheet arrival sensor 58 to sense the arrival of the top most sheet 30 within the allotted time and thus fail to send the appropriate signal to the controller 50, in combination with the pick sensor 60 detecting rotation of the pick roll 26 and thus sending the appropriate signal to the controller 50 within the allotted time or, in other words, an answer of YES, as per block 102, provides a combination of states at the controller 50 indicating the occurrence of the 'fails to feed' failure mode as per block 108. This causes the controller 50 to then output a signal commanding a motor 62 operatively connected to the stack elevator 18 to turn-on and move the elevator 18 downward in the direction of arrow 64, thereby lowering the elevator 18 and therewith the top of the stack 12 by a small distance, $d_1$, as can be seen in FIG. 2 and as per block 110 in FIG. 5. This readjustment of the elevation of the top of the stack 12 by lowering it changes the geometrical relationship of the pick arm 28 toward a more inclined orientation with the top of the media stack 12. This readjustment is just enough to allow the pick arm 28 to generate a sufficient additional normal force, as per arrow 54, on the top most sheet 30 to grip and advance it upward along the inclined surface 24 of the restraint dam 16 past the sheet arrival sensor 58 and to the media path entry nip 32 in the ordinary expected manner described earlier. The block 110 feeds back to block 104 and the answer or response to the question, "Did sheet arrive at sensor?", now changes to YES and indicates, as per block 106, that the sheet was fed successfully.

On the other hand, if the pick arm 28 is in the maximum inclined orientation as depicted in FIG. 3, the most common failure mode is the 'sheet feed stall' failure mode, as mentioned earlier. This occurs when the controller 50 supplies sufficient current to turn on the motor 46 and power the pick roll 26 of the pick mechanism 14 to rotate but there is no rotation of the pick roll 26 sensed by the motor pick sensor 60 of the pick arm 28. In this case no signal is received from the pick sensor 60 in the preset time so the answer to the question, as per block 102, "Is pick roll rotating?" is NO. The method then branches from block 102 to block 112, which indicates that a 'pick roll stall' failure mode has occurred.

Referring to FIG. 4, there is illustrated a second feature of the sheet feeding method of the present invention wherein the aforementioned geometrical relationship of the pick arm 28 to the top of the media stack 12 is changed in response to the occurrence of the 'sheet feed stall' failure mode. Again, the occurrence of this failure mode is recognized by the controller 50 when it does not receive the appropriate signal in the allotted time from the onboard pick sensor 60. Upon recognizing this occurrence as per block 112, the controller 50 outputs a signal commanding turn-on of the motor 62, operatively connected to the stack elevator 18, to move the elevator 18 upward in the direction of arrow 64, as per block 114, thereby raising the elevator 18 and therewith the top of the stack 12 by a small distance, $d_2$, as can be seen in FIG. 4. This readjustment of the elevation of the top of the stack 12 by raising it changes the geometrical relationship of the pick arm 28 with the top of the media stack 12 toward a less inclined orientation. This readjustment is just enough to allow the pick arm 28 to be less aggressive and generate a reduced normal force, as per arrow 54, on the top most sheet 30 and hence reduced frictional adhesion between the top sheet 30 and the sheet 56 immediately beneath it, thereby allowing only the top sheet 30 to advance upward along the inclined surface 24 of the restraint dam 16 toward the media path entry nip 32. Additionally the movement of the elevator 18 up without the pick motor 46 being energized will move the top most sheet 30 toward the restraint dam 24 by the rotation of the pick arm 28 up and slightly toward the restraint dam 24. The block 114 feeds back to the input side of block 102 where the answer to the question "Is pick roll rotating?" now changes to YES as does also the answer to the question of block 104, "Did sheet arrive at sensor?", such that the method now branches from block 104 to block 106 indicating a successful feed of the sheet.

Another failure mode is the 'multiple sheet feed'. This occurs when more than one sheet is fed at the same time. Sometimes a set of multiple sheets, usually two, travels through the image forming machine without ever being detected. Other times the sheet may appear to be too long and cause a paper jam. If this is detected and previous sheets from the same input source were not detected as too long the machine may assume the failure mode to be a 'multiple sheet feed'. Multiple sheet feeds are caused partially by a high normal force 54 increasing the frictional force between sheet 30 and sheet 56 causing sheet 56 to move with sheet 30. When this happens sheet 56 is typically 1 in. to 1.5 in. later than sheet 30. This is sensed as a longer than anticipated sheet at the sheet arrival sensor 58. The trailing edge of sheet 56 is sensed about 0.15 in. plus paper length after the leading edge of sheet 30 is sensed. As mentioned the increase in normal force may cause this and to resolve it the elevator 18 should be raised to lower the normal force.

The advantages of the sheet feeding method of the present invention for overcoming media handling failure modes are the following: (1) media that occasionally experience a 'fails to feed' failure mode due to the pick arm 28 being at the nearly horizontal orientation can now be fed; and (2) media that occasionally experience a 'sheet feed stall' failure mode of the pick mechanism 14 when the pick arm 28 is at the maximum inclined orientation can now be fed; and (3) media that occasionally experience a 'multiple sheet feed' failure mode can now be fed. One potential disadvantage, however, is that the algorithm employed by the controller 50 for controlling the operation of the pick mechanism 14 is now somewhat more complex. Nonetheless, implementation the method of the present invention would appear to be a net positive in terms of improved operating efficiency when these multiple advantages are compared with the one disadvantage.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media sheet feeding method for overcoming a media handling failure mode, comprising:

supporting a media stack on a generally vertically movable elevator;

initiating operation of a pick roll in conjunction with a top most sheet of the media stack;

sensing whether or not the pick roll is operating in a preselected manner in conjunction with the top most sheet; and raising the elevator a preset distance if a first condition of the pick roll in conjunction with the top most sheet is sensed to decrease a normal force imposed on the top most sheet by the pick roll, and lowering the elevator a preset distance if a second condition of the pick roll in conjunction with the top most sheet is sensed to increase the normal force imposed on the top most sheet by the pick roll, in order to overcome the occurrence of a media handling failure mode between the pick roll and the top most sheet of the media stack.

2. The method of claim 1 wherein said initiating operation of the pick roll includes transmitting rotary motive power to the pick roll.

3. The method of claim 2 wherein said initiating operation of the pick roll further includes engaging the pick roll with a top most sheet of the media stack supported on the elevator in order to pick and separate the top most sheet from the next sheet beneath the top most sheet and feed just the top most sheet from the stack.

4. The method of claim 1 wherein said sensing whether or not the pick roll is operating in the preselected manner in conjunction with the top most sheet includes sensing whether or not the pick roll is rotating to determine whether or not a 'pick roll stall' failure mode has occurred.

5. The method of claim 4 wherein said raising the elevator is in response to the pick roll not rotating within a preset time after initiating operation of the pick roll in order to cause rotation of the pick roll and feeding of only the top most sheet from the stack and thereby overcome the 'pick roll stall' failure mode.

6. The method of claim 1 wherein said sensing whether or not the pick roll is operating in a preselected manner in conjunction with the top most sheet includes sensing whether or not the pick roll is rotating and sensing whether or not the top most sheet has arrived at a sheet arrival sensor to determine whether or not a 'fails to feed' failure mode has occurred.

7. The method of claim 6 wherein said lowering the elevator is in response to the pick roll rotating within a preset time but the top most sheet not arriving at the sheet arrival sensor within a preset time after initiating operation of the pick roll in order to cause feeding of only the top most sheet from the stack and thereby overcome the 'fails to feed' failure mode.

8. The method of claim 1 wherein said lowering the elevator is in response to the pick roll rotating but the top most sheet not arriving at a sheet arrival sensor to overcome the occurrence of a 'fails to feed' failure mode.

9. The method of claim 1 wherein said raising the elevator is in response to the pick roll not rotating to overcome the occurrence of a 'pick roll stall' failure mode.

10. A media sheet feeding method for overcoming media handling failure modes, comprising:

supporting a media stack on a generally vertically movable elevator;

initiating operation of a pick roll by transmitting rotary motive power thereto and engaging the pick roll with a top most sheet of the media stack in order to pick and separate the top most sheet from the next sheet beneath the top most sheet and feed just the top most sheet from the stack;

sensing whether or not the pick roll is rotating and whether or not the top most sheet has arrived at a sheet arrival sensor to determine whether or not a media handling failure mode has occurred; and moving the elevator in a predetermined direction through a preset distance, in response to at least one of the pick roll not rotating within a preset time or the top most sheet not arriving at the sheet arrival sensor within a preset time after initiating operation of the pick roll, in order to sufficiently change a normal force imposed on the top most sheet by the pick roll so as to overcome the occurrence of the media handling failure mode.

11. The method of claim 10 wherein said sensing whether or not the pick roll is rotating determines whether or not a 'pick roll stall' failure mode has occurred.

12. The method of claim 11 wherein said moving the elevator includes raising the elevator, in response to the pick roll not rotating, to decrease the normal force imposed on the top most sheet to overcome the occurrence of the 'pick roll stall' failure mode.

13. The method of claim 10 wherein said sensing whether or not the pick roll is rotating and sensing whether or not the top most sheet has arrived at a sheet arrival sensor determines whether or not a 'fails to feed' failure mode has occurred.

14. The method of claim 13 wherein said moving the elevator includes lowering the elevator, in response to the pick roll rotating but the top most sheet not arriving at a sheet arrival sensor, to increase a normal force imposed on the top most sheet to overcome the occurrence of the 'fails to feed' failure mode.

15. A media sheet feeding method for overcoming a media handling failure mode, comprising:

supporting a media stack on a generally vertically movable elevator;

initiating operation of a pick roll in conjunction with a top most sheet of the media stack;

sensing whether or not the pick roll is rotating to determine whether or not a 'pick roll stall' failure mode has occurred; and moving the elevator vertically in a selected direction through a preset distance, in response to sensing that the pick roll is not rotating in conjunction with the top most sheet, in order to overcome the occurrence of the 'pick roll stall' failure mode between the pick roll and the top most sheet of the media stack.

16. The method of claim 15, wherein said moving the elevator vertically a preset distance includes raising the elevator, in response to the pick roll not rotating within a preset time after initiating operation of the pick roll, in order to sufficiently decrease a normal force imposed on the top most sheet by the pick roll to cause rotation of the pick roll and feeding of only the top most sheet from the stack and thereby overcome the 'pick roll stall'failure mode.

17. A media sheet feeding method for overcoming a media handling failure mode, comprising:

supporting a media stack on a generally vertically movable elevator;

initiating operation of a pick roll in conjunction with a top most sheet of the media stack;

sensing whether or not the pick roll is rotating and sensing whether or not the top most sheet has arrived at a sheet arrival sensor to determine whether or not a 'fails to feed' failure mode has occurred; and moving the elevator vertically in a selected direction through a preset distance, in response to sensing that the pick roll is rotating but the top most sheet not arriving at the sheet arrival sensor, in order to overcome the occurrence of the 'fails to feed' failure mode between the pick roll and the top most sheet of the media stack.

18. The method of claim 17 wherein said moving the elevator vertically a preset distance includes lowering the elevator, in response to the pick roll rotating within a preset time but the top most sheet not arriving at the sheet arrival sensor within a preset time after initiating operation of the pick roll, in order to sufficiently increase a normal force imposed on the top most sheet by the pick roll to cause feeding of only the top most sheet from the stack and thereby overcome the 'fails to feed' failure mode.

19. A media sheet feeding method for overcoming a media handling failure mode, comprising:

supporting a media stack on a generally vertically movable elevator;

initiating operation of a pick roll in conjunction with a top most sheet of the media stack;

sensing whether or not the pick roll is rotating and sensing whether or not the top most sheet has arrived at a sheet arrival sensor; and lowering the elevator through a preset distance, in response to sensing that the pick roll is rotating but the top most sheet not arriving at a sheet arrival sensor, in order to increase a normal force imposed on the top most sheet to overcome the occurrence of a 'fails to feed' failure.

20. A media sheet feeding method for overcoming a media handling failure mode, comprising:

supporting a media stack on a generally vertically movable elevator;

initiating operation of a pick roll in conjunction with a top most sheet of the media stack;

sensing whether or not the pick roll is rotating in conjunction with the top most sheet; and raising the elevator through a preset distance, in response to sensing that the pick roll is not rotating, in order decrease a normal force imposed on the top most sheet to overcome the occurrence of a 'pick roll stall' failure mode.

* * * * *